US010875743B2

(12) United States Patent
Hollowell et al.

(10) Patent No.: US 10,875,743 B2
(45) Date of Patent: Dec. 29, 2020

(54) ROPE-CLIMBING SELF PROPELLED ELEVATOR SYSTEM

(71) Applicant: Otis Elevator Company, Farmington, CT (US)

(72) Inventors: Richard L. Hollowell, Georgetown, SC (US); Kiron Bhaskar, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/009,969

(22) Filed: Jun. 15, 2018

(65) Prior Publication Data

US 2018/0362302 A1 Dec. 20, 2018

Related U.S. Application Data

(60) Provisional application No. 62/521,083, filed on Jun. 16, 2017.

(51) Int. Cl.
*B66B 9/00* (2006.01)
*B66B 11/00* (2006.01)
(Continued)

(52) U.S. Cl.
CPC ..... *B66B 9/00* (2013.01); *B66B 7/068* (2013.01); *B66B 11/007* (2013.01);
(Continued)

(58) Field of Classification Search
CPC ..... B66B 9/00; B66B 7/068; B66B 11/0035; B66B 11/007; B66B 11/0095; B66B 11/0438; B66B 11/08; B66B 15/04
See application file for complete search history.

(56) References Cited

U.S. PATENT DOCUMENTS 5,464,072 A * 11/1995 Muller ..... B66B 9/02 187/249
5,636,712 A * 6/1997 Muller ..... B66B 9/02 187/249
(Continued)

FOREIGN PATENT DOCUMENTS

CN 1342130 A 3/2002
CN 101204809 A 6/2008
(Continued)

OTHER PUBLICATIONS

European Search Report Issued in EP Application No. 18176989.4; dated Nov. 29, 2018, 7 pages.
(Continued)

*Primary Examiner* — Michael A Riegelman
(74) *Attorney, Agent, or Firm* — Cantor Colburn LLP

(57) ABSTRACT

An elevator system includes a hoistway and an elevator car positioned in and movable along the hoistway. The elevator car includes a first sheave and a second sheave spaced apart from the first sheave. The first sheave and second sheave have parallel axes of rotation and each include a traction surface and a gearless prime mover operably connected to the traction surface to drive rotation of the traction surface. A first load bearing member is positioned in the hoistway and a second load bearing member is positioned in the hoistway. The first load bearing member passes laterally under the first sheave, vertically upward between the first sheave and the second sheave, and laterally over the second sheave. The second load bearing member passes laterally under the second sheave, vertically between the second sheave and the first sheave, and laterally over the first sheave.

14 Claims, 5 Drawing Sheets

(51) Int. Cl.

| | |
|---|---|
| ***B66B 7/06*** | (2006.01) |
| ***B66B 11/08*** | (2006.01) |
| ***B66B 11/04*** | (2006.01) |
| ***B66B 15/04*** | (2006.01) |

(52) U.S. Cl.
CPC ..... *B66B 11/0035* (2013.01); *B66B 11/0095* (2013.01); *B66B 11/0438* (2013.01); *B66B 11/08* (2013.01); *B66B 15/04* (2013.01); *B66B 2009/006* (2013.01)

(56) References Cited

U.S. PATENT DOCUMENTS

| | | | | |
|---|---|---|---|---|
| 5,931,265 | A * | 8/1999 | Hollowell | B66B 7/062 187/249 |
| 6,193,016 | B1 | 2/2001 | Hollowell et al. | |
| 6,202,793 | B1 * | 3/2001 | Fargo | B66B 11/0438 187/256 |
| 7,296,661 | B1 * | 11/2007 | Petricio Yaksic | B66B 11/005 187/256 |
| 2015/0122589 | A1 * | 5/2015 | Mezzadri | B66B 1/306 187/290 |
| 2016/0194179 | A1 * | 7/2016 | Agirman | B66B 1/32 187/289 |
| 2017/0101291 | A1 * | 4/2017 | Bogli | B66B 5/0025 |
| 2017/0267492 | A1 * | 9/2017 | Lotfi | B66B 9/00 |
| 2018/0327227 | A1 * | 11/2018 | Hollowell | B66B 9/027 |
| 2018/0362302 | A1 * | 12/2018 | Hollowell | B66B 11/007 |
| 2019/0067981 | A1 * | 2/2019 | Saarela | H02J 7/14 |
| 2019/0077637 | A1 * | 3/2019 | Bhaskar | B66B 11/005 |

FOREIGN PATENT DOCUMENTS

| | | | |
|---|---|---|---|
| CN | 204689319 | U | 10/2015 |
| CN | 106494974 | A | 3/2017 |
| DE | 19860458 | C1 | 6/2000 |
| EP | 0867395 | A2 | 9/1998 |
| EP | 1818303 | B1 | 2/2010 |
| EP | 2014598 | B1 | 5/2010 |
| EP | 2303750 | B1 | 10/2013 |
| EP | 2019073 | B1 | 11/2016 |
| FR | 2640604 | B1 | 3/1991 |
| JP | 2007238201 | A | 9/2007 |
| JP | 5607703 | B2 | 10/2014 |
| WO | 9943601 | A2 | 9/1999 |
| WO | 2004067430 | A1 | 8/2004 |
| WO | 2014029899 | A1 | 2/2014 |
| WO | 2015056646 | A1 | 4/2015 |

OTHER PUBLICATIONS

Chinese Office Action Issued in CN Application No. 201810620574.7, dated Oct. 9, 2019, 9 Pages.

* cited by examiner

ROPE-CLIMBING SELF PROPELLED ELEVATOR SYSTEM

CROSS-REFERENCE TO RELATED APPLICATIONS

This application claims the benefit of 62/521,083, filed Jun. 16, 2017, which is incorporated herein by reference in its entirety.

BACKGROUND

Exemplary embodiments pertain to the art of elevator systems, and more particularly to rope-climbing elevator systems.

Typical elevator systems utilize an elevator car suspended in a hoistway via one or more load bearing members, such as ropes or belts. The load bearing members are driven via a traction arrangement with a drive machine and drive sheave fixed in the hoistway, thus moving the elevator car along the hoistway.

Such arrangements are problematic if certain conditions, such as driving multiple elevator cars along the same hoistway are desired. Further, the typical system requires many additional components separate from the elevator car in addition to the drive machine and drive sheave, such as a counterweight also located in the hoistway. In an attempt to alleviate these issues, self-propelled elevator cars have been introduced, usually utilizing a rack and pinion arrangement in which a geared pinion on the elevator car engages a linear rack extending vertically along the hoistway, and utilizing linear induction motors with primary and secondary armatures disposed on the elevator car and the hoistway, respectively, to drive the elevator car along the hoistway.

BRIEF DESCRIPTION

In one embodiment, an elevator system includes a hoistway and an elevator car positioned in and movable along the hoistway. The elevator car includes a first sheave and a second sheave spaced apart from the first sheave. The first sheave and second sheave have parallel axes of rotation and each include a traction surface and a gearless prime mover operably connected to the traction surface to drive rotation of the traction surface. A first load bearing member is positioned in the hoistway and a second load bearing member is positioned in the hoistway. The first load bearing member passes laterally under the first sheave, vertically upward between the first sheave and the second sheave, and laterally over the second sheave. The second load bearing member passes laterally under the second sheave, vertically between the second sheave and the first sheave, and laterally over the first sheave.

Additionally or alternatively, in this or other embodiments the gearless prime mover is a hub wheel motor.

Additionally or alternatively, in this or other embodiments the hub wheel motor is mounted on a shaft.

Additionally or alternatively, in this or other embodiments the gearless prime mover is operably connected to a power source located remotely from the elevator car.

Additionally or alternatively, in this or other embodiments the prime mover is configured to generate electrical power and return the generated electrical power to the power source.

Additionally or alternatively, in this or other embodiments the connection to the remotely-located power source is one of inductive or conductive.

Additionally or alternatively, in this or other embodiments an interface between the prime mover and the remotely-located power source includes a power storage module.

Additionally or alternatively, in this or other embodiments the load bearing member is one of a rope or a belt.

Additionally or alternatively, in this or other embodiments a second elevator car is located in the hoistway. The second elevator car includes third sheave and a fourth sheave spaced apart from the third sheave. The third sheave and fourth sheave have parallel axes of rotation and each include a traction surface and a gearless prime mover operably connected to the traction surface to drive rotation of the traction surface. A third load bearing member is located in the hoistway and a fourth load bearing member is located in the hoistway. The third load bearing member passes laterally under the third sheave, vertically upward between the third sheave and the fourth sheave, and laterally over the fourth sheave. The fourth load bearing member passes laterally under the fourth sheave, vertically between the fourth sheave and the third sheave, and laterally over the third sheave.

Additionally or alternatively, in this or other embodiments the third sheave is axially offset from the first sheave and the fourth sheave is axially offset from the seconds sheave.

Additionally or alternatively, in this or other embodiments a third or more elevator car is located in the hoistway.

Additionally or alternatively, in this or other embodiments one or more tension offset devices are positioned in the hoistway to selectively restrain and release the first load bearing member and/or the second load bearing member to control the tension of the first load bearing member and/or the second load bearing member.

Additionally or alternatively, in this or other embodiments the tension offset device is configured to release an associated load bearing member before the elevator car passes the tension offset device and restrain the associated load bearing member after the elevator car passes the tension offset device.

Additionally or alternatively, in this or other embodiments the tension offset device is configured to apply an upward force to the first load bearing member and/or the second load bearing member.

In another embodiment, a method of operating an elevator system includes supplying electrical power to a first sheave located at an elevator car having s a first gearless prime mover and a second sheave located at the elevator car having a second gearless prime mover to drive rotation of the first sheave and the second sheave via operation of the first gearless prime mover and the second gearless prime mover. The first sheave is spaced from the second sheave and have parallel axes of rotation. A first load bearing member is urged laterally under the first sheave, vertically upward between the first sheave and the second sheave, and laterally over the second sheave via rotation of the first sheave and the second sheave. A second load bearing member is urged laterally under the second sheave, vertically between the second sheave and the first sheave, and laterally over the first sheave via rotation of the first sheave and the second sheave. The urging of the first load bearing member and the second load bearing member urges the elevator car along a hoistway of the elevator system.

Additionally or alternatively, in this or other embodiments the first gearless prime mover and the second gearless prime mover are hub wheel motors.

Additionally or alternatively, in this or other embodiments electrical power is transferred from a power source remotely located from the elevator car to the elevator car via a wireless connection.

Additionally or alternatively, in this or other embodiments electrical power is stored at the elevator car.

Additionally or alternatively, in this or other embodiments electrical power is supplied to a third sheave having a third gearless prime mover located at a second elevator car and a fourth sheave disposed at the second elevator car having a fourth gearless prime mover to drive rotation of the third sheave and the fourth sheave via operation of the third gearless prime mover and the fourth gearless prime mover. The third sheave is spaced from the fourth sheave and have parallel axes of rotation. A third load bearing member is urged laterally under the third sheave, vertically upward between the third sheave and the fourth sheave, and laterally over the fourth sheave via rotation of the third sheave and the fourth sheave. A fourth load bearing member is urged laterally under the fourth sheave, vertically between the fourth sheave and the third sheave, and laterally over the third sheave via rotation of the third sheave and the fourth sheave. The urging of the third load bearing member and the fourth load bearing member urges the elevator car along a hoistway of the elevator system.

Additionally or alternatively, in this or other embodiments a load bearing member is held and an upward force is applied thereto via a tension offset device located in the hoistway. An associated load bearing member is released from the tension offset device before the elevator car passes the tension offset device and the associated load bearing member is restrained via the tension offset device after the elevator car passes the tension offset device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
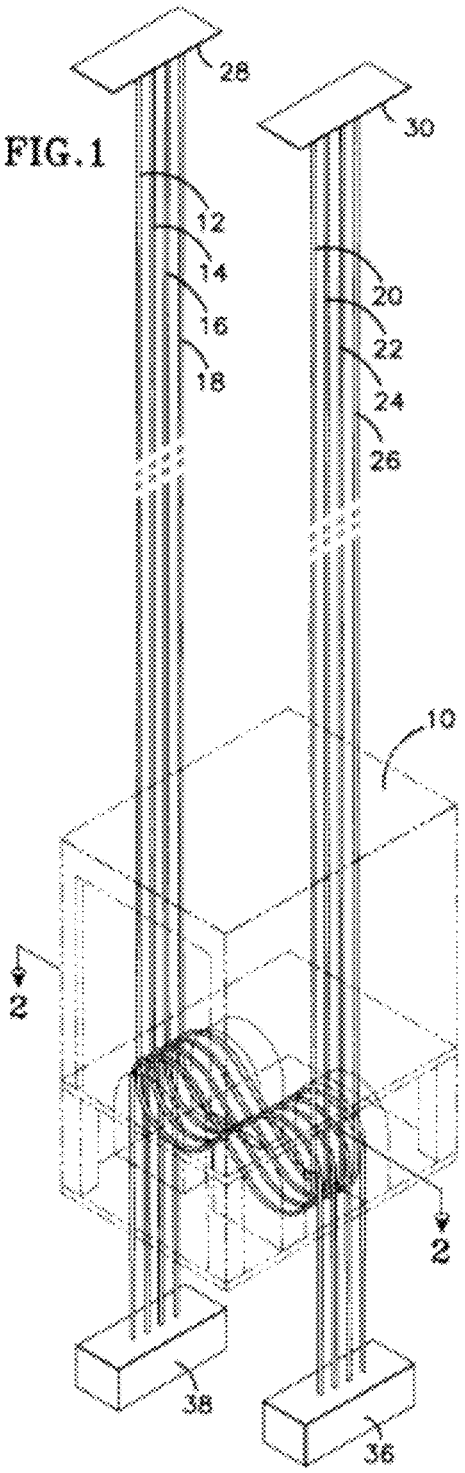
FIG. 1 is a schematic view of an embodiment of an elevator system.

Referring to FIG. 1, an elevator system 100 includes an elevator car 10 located within a hoistway (not shown). A plurality of vertical ropes 12-26 hang in two groups of four vertically downward from upper securing points 28,30. The ropes engage counter rotating paired drive sheaves 32, 34 disposed, in this embodiment, beneath the elevator car 10 in a manner as will be further described. Each group of ropes 12-18 and 20-26 terminate at their lower vertical ends at respective weights 36,38 or other tensioning means, including springs, hydraulic actuators, electromagnetic actuators or any other means Well known in the art for imparting a tensile force on a rope.

Figure 2:
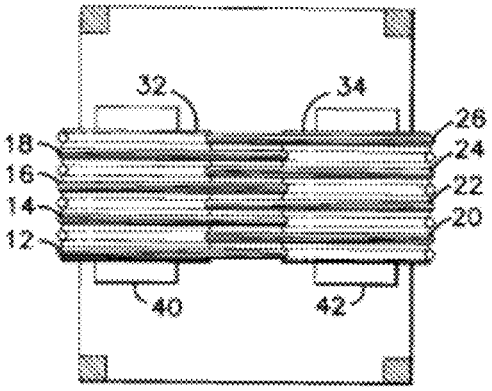
FIG. 2 is a schematic plan view of a sheave arrangement for an elevator car of an elevator system.
Figure 3:
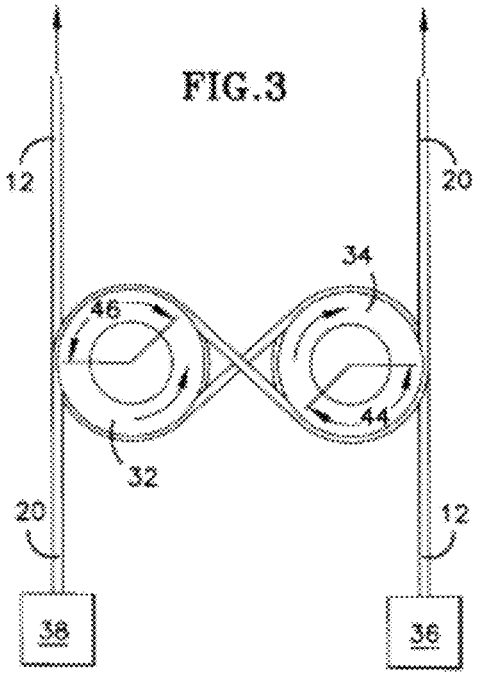
FIG. 3 is another schematic view of a sheave arrangement for an elevator system.

Referring now in particular to FIGS. 2 and 3, the operation of a rope climbing elevator according to the present disclosure may be described. Drive sheaves 32, 34 are driven in opposite directions by prime movers 40, 42, respectively. As shown in FIG. 3, rope 20, hanging vertically downward within the hoistway shaft (not shown) and outside of the travel volume of the elevator car 10, passes underneath drive sheave 34, turning laterally and vertically upward to pass over drive sheave 32, turning again vertically downward and terminating at tensioning weight 38 in the lower portion of the hoistway shaft. In describing this path, rope 20 engages a substantial arc 44 on the lower portion of sheave 34 and a similar size arc 46 on the upper portion of drive sheave 32. The substantial engagement arc with the drive sheaves 32, 34, coupled with the tension provided in rope 20 by means of that portion hanging vertically downward from drive sheave 32 as well as any tension force provided by the tension means 38, allow the sheave and rope system shown in FIGS. 1-3 to achieve sufficient traction to cause the counter rotation of sheaves 32, 34 to drive the elevator vertically upward or downward as desired. As will be appreciated by those skilled in the art, ropes 12-18 and 22-26 shown in FIGS. 1 and 2 each engage corresponding upper and lower portions of drive sheaves 32, 34 as described for rope 20 above.

Prime movers 40, 42 are shown schematically and are representative of any of a number of well-known means for imparting controllable counter rotation to sheaves 32, 34 with sufficient power to lift the elevator car 10 and its contents in the manner described. As such, the prime mover or prime movers may be powered by electricity, and coupled to the sheaves either mechanically by means of gears, chains, belts, or the like, hydraulically or directly, depending upon the required power, or other application specific parameters. Although it is believed preferable, due to load balancing, torque balancing, smoothness, and other considerations, that both sheaves 32,34 be driven in a counter-rotating direction, the elevator arrangement according to the present disclosure is operable using only one driven sheave with the other sheave serving as an idler.

Figure 6:
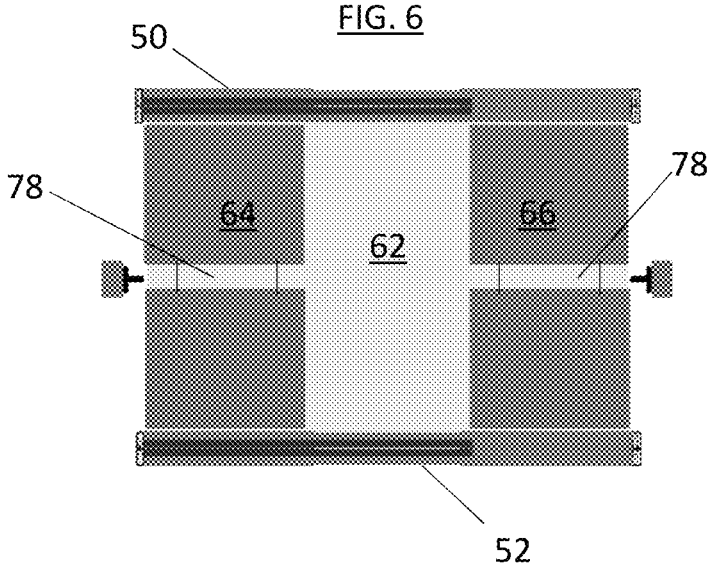
FIG. 6 is another schematic view of a sheave arrangement at an elevator car of an elevator system.
Figure 7:
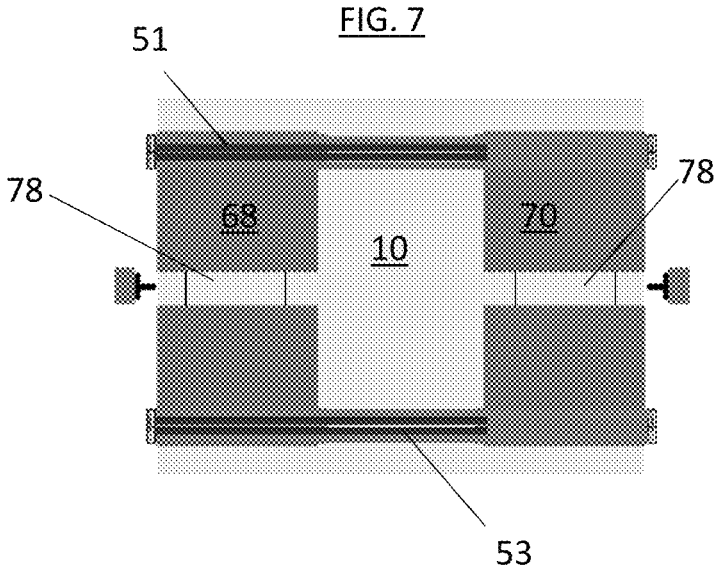
FIG. 7 is yet another schematic view of a sheave arrangement at an elevator car of an elevator system.
Figure 8:
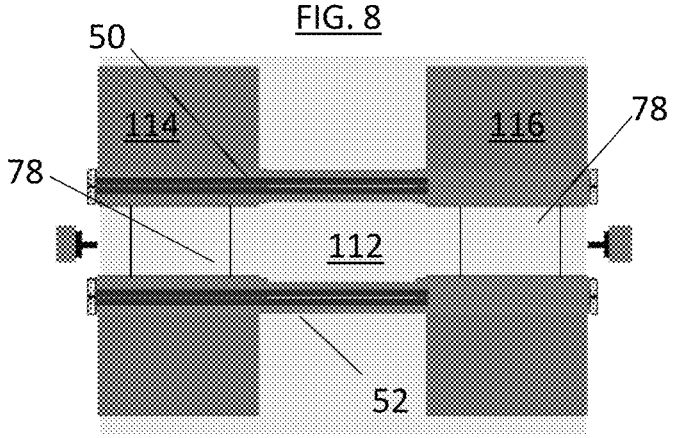
FIG. 8 is still another schematic view of a sheave arrangement at an elevator car of an elevator system.

In some embodiments, the prime movers 40, 42 are hub wheel motors which are integrated into the drive sheaves 32, 34. The hub wheel motors are gearless motors having the motor, inverter and bearing integrated into the hub wheel motor and disposed radially inside of the drive sheaves 32, 34, which are mounted on a shaft 78. In some embodiments, such as shown in FIGS. 6-8, more than one drive sheave is mounted on each shaft 78.

Power may be supplied to the moving car 10 and prime movers 40, 42 by means of any of a number of arrangements well known and used currently in the art, including vertically oriented electrical bus bars disposed on the hoistway wall and moving contacts disposed on the elevator car, a traveling cable running between the car and a power connection point on the elevator wall, etc.

Figure 4:
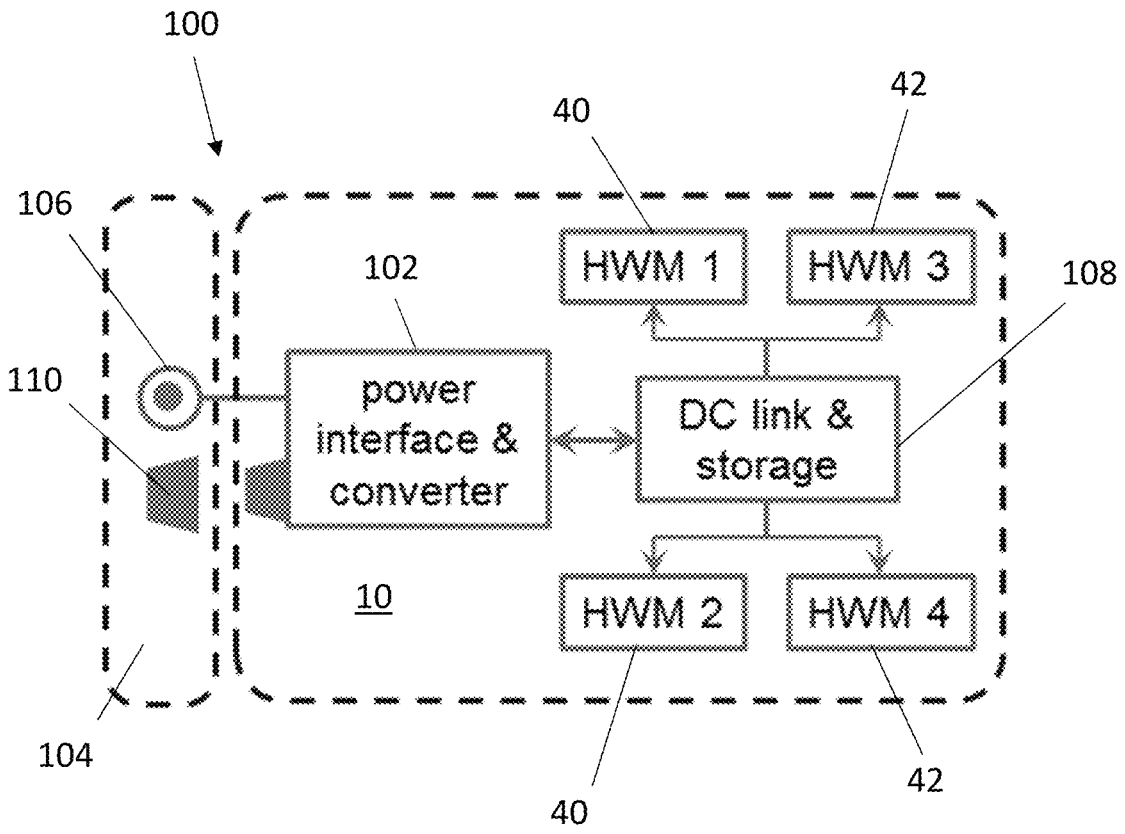
FIG. 4 is a schematic view of a power system for an elevator system.

For example, as shown in FIG. 4, in the elevator system of the present disclosure, propulsion, control and safety functions of the elevator system are located at the elevator car 10. Power is provided to the elevator car 10 via a power interface system 100, which includes a power interface and converter 102 located at the car 10. Further, the power interface and converter 102 is connected to a power source 104 via, for example a wired interface 106, having continuous contact with the power source 104 during travel throughout the hoistway. A DC link and power storage module 108 is located at the elevator car 10 and connected to each of the prime movers 42, 44 to drive the prime movers 42, 44. In addition, in some embodiments, the prime movers 42, 44 have a regeneration function in which electrical power is generated at the prime movers 42, 44 during braking operation of the prime movers 42, 44. The regenerated electrical power may be stored at the DC link and power storage module 108 or alternatively sent back to the power source 104 via the wired interface 106.

Additionally, in some embodiments the power interface system 100 may include a wireless interface 110, which may transfer power between the power source 104 and the elevator car 10 via, for example, inductive power transfer or resonant power transfer. The wireless interface 110 may be located and may be operative at select locations along the hoistway, such as at designated charging stations or at a lobby floor. Further, the elevator car 10 may include a wireless communications interface 140 for communications between, for example, the elevator car 10 and an off-car elevator control system 142.

The embodiment as described above and shown in FIGS. 1-3 permits the elevator car 10 to operate vertically without the need for a separate machine room in an extended overhead space (not shown) or in a lower pit area (not shown). Further, the arrangement as shown and described does not require a moving counterweight or other similar arrangement to tension the ropes passing over the drive sheaves thereby avoiding the need to provide additional space within the hoistway to accommodate the vertically moving counterweight. As such, elevator systems according to the present disclosure may be particularly well suited for older or modern buildings for which there is a need to provide elevator service while accommodating limitations on the amount of space available for use. Alternatively, the use of a separately roped counterweight arrangement, (not shown) may be used to reduce the prime mover power requirement.

As will be further appreciated by those skilled in the art, the arrangement according to the present disclosure will permit the elevator prime mover 40,42, or machine, the motor drive (not shown) and controller (not shown) to be packaged, thus reducing shipping and installation time and cost.

Figure 5:
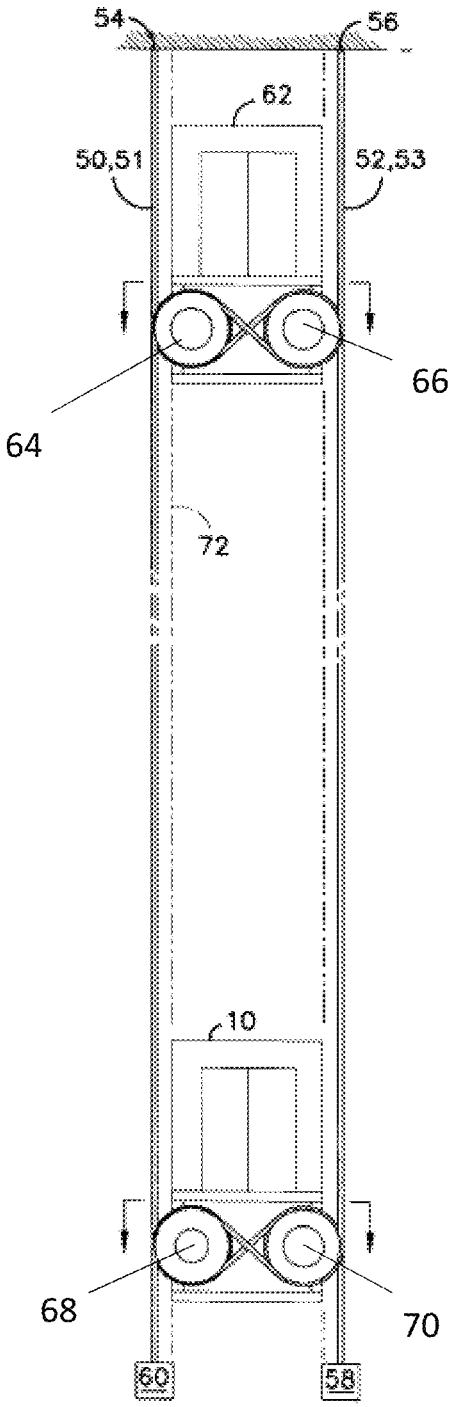
FIG. 5 is another schematic view of an embodiment of an elevator system.

FIGS. 5-8 illustrate another embodiment of the elevator system according to the present disclosure. As in the first embodiment, FIG. 5 shows a plurality of stationary ropes disposed in two groups 50,52 secured at their respective upper ends 54,56 and hanging vertically downward, terminating at the lower ends with respective tensioning means 58,60. In addition to the first car 10, however, this second embodiment includes a second car 62 which is operable within at least a portion of the vertical travel elevator of the first car 10 as described below. As may be viewed clearly in FIGS. 6 and 7, cars 62 and 10 each include counter-rotating drive sheaves 64, 66, 68 and 70, respectively. The counter-rotating sheaves 64, 66 of the upper car 62 each first engage respective groups of ropes 50, 52 as described for the first embodiment. With regard to car 10, drive sheave pairs 68,70 likewise engage opposite rope groups 51,53 disposed laterally outside of the travel volume of the elevator cars 10,62 and adjacent ropes 50,52 engaged by car 62. The drive sheave pairs 64, 66 are offset from the location of drive sheaves 68, 70 to accommodate engagement with the ropes 50, 52 and 51, 53, respectively without interference with the other ropes and drive sheaves. Further as shown in FIG. 8, in some embodiments, a third elevator car 112 may be included and includes sheave pairs 114, 116 that engage with rope pairs 118, 120. Sheave pairs 114, 116 are offset from both sheave pairs 64, 66 and 68, 70 to allow for operation of the three elevator cars 10, 62 and 112 in the same hoistway. One skilled in the art will readily appreciate that additional elevator cars may be placed in the hoistway, subject to space and alignment constraints.

The operation of the second embodiment according to the present disclosure may now be understood. Elevator cars 10, 62 may each simultaneously occupy a position within a shared travel volume 72 each servicing the same floor via the same hoistway shaft and doors. As each car contains an independent prime mover, and as the shared vertical travel zone 72 is unoccupied by any central ropes or other impediments, the elevators are constrained, in this embodiment, only by the restriction that they are unable to pass each other in the vertical direction. Vertical tensioning means 58, 60 shown in FIG. 5 comprise a plurality of individual weights, secured to each rope or group of ropes, or individual spring or hydraulic tensioning members as discussed herein.

The flexibility of the second embodiment according to the present disclosure, provides increased flexibility, load capacity and other features in a single vertical hoistway. For extremely high-rise applications, transfer between banks of elevators in a sky lobby or other transfer arrangement may be accomplished by exiting a car traversing, for example, a lower range of floors and reentering, via the same lobby door, an elevator car servicing an upper range of floors. Other possibilities include, for example, dispatching an express elevator from an entrance level floor during a peak period which operates non-stop to an upper floor, while providing a local elevator car, at the same lobby entrance to follow servicing intermediate lower floors. These and other arrangements and advantages will become apparent to those skilled in the art having appreciated the flexibility and functionality provided by elevator system according to the present disclosure.

Figure 9:
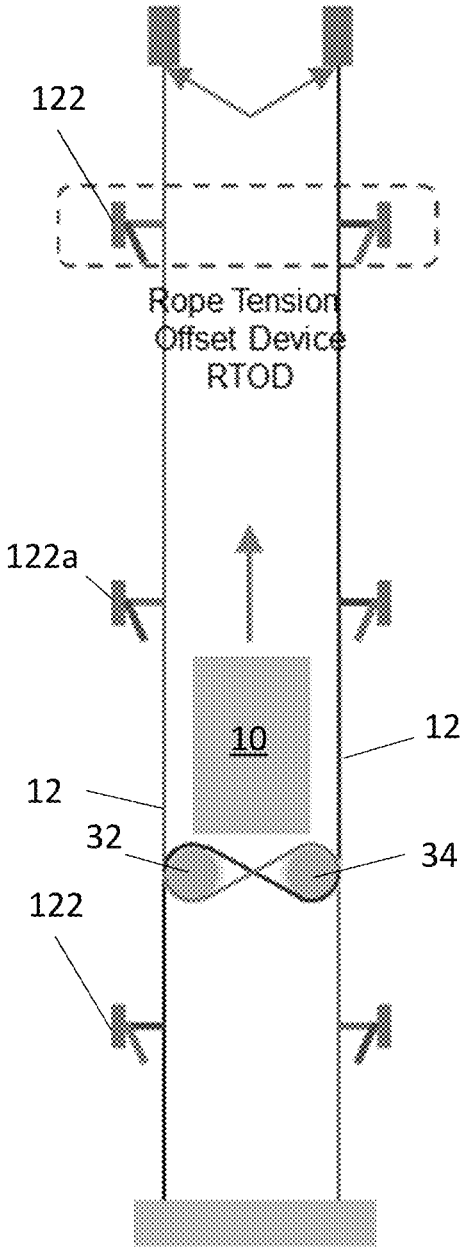
FIG. 9 is another schematic view of an embodiment of an elevator system.
Figure 10:
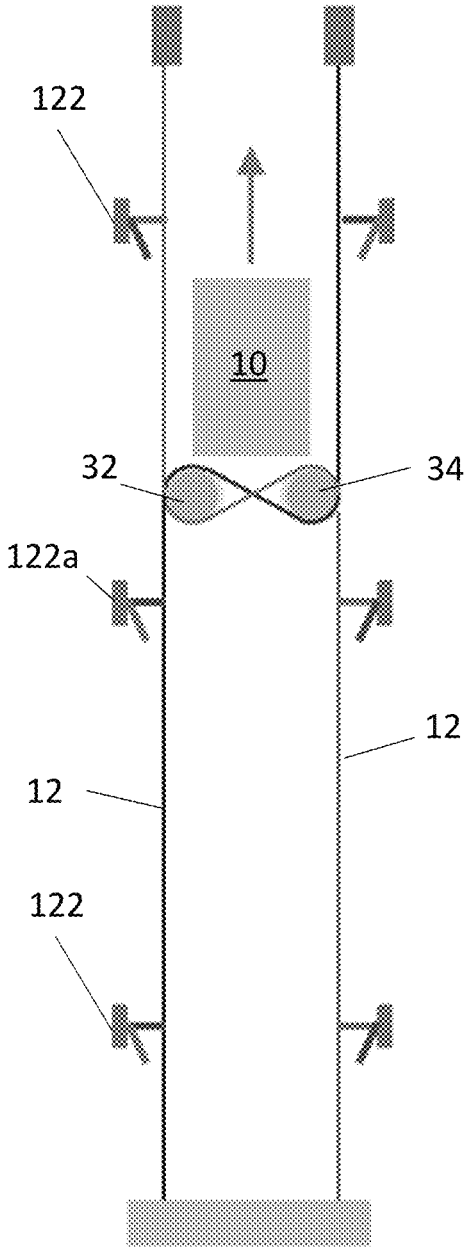
FIG. 10 is yet another schematic view of an embodiment of an elevator system.

In some embodiments, such as shown in FIGS. 9 and 10, the elevator system includes rope tension offset devices (ROTDs) 122, fixed in the hoistway at preselected intervals. The ROTDs 122 are arranged in pairs, and engages the ropes located thereat. When engaged, the ROTDs 122 apply a controlled upward force to relieve tension on the ropes, thus reducing a peak rope tension of the ropes. As the elevator car 10 moves in the hoistway approaching ROTD pair 122*a*, immediately in the path of the elevator car 10, the RODs 122*a* will disengage the ropes allowing the elevator car 10 to pass. Once the elevator car 10 passes the ROTD pair 122*a*, the ROTDs 122*a* will reengage the ropes to relieve the tension thereon. While three pairs of ROTDs 122 are illustrated in FIGS. 9 and 10, one skilled in the art will readily appreciate that other suitable quantities of ROTDs 122 may be utilized. The ROTDs 122 act to control a tension of the ropes, to not only reduce peak rope tension but to ensure there is adequate traction between the ropes and the drive sheaves 32, 34. If an upward force applied by the ROTDs 122 to the ropes is too low, peak rope tension will be too high, while if the upward force applied to the ropes is too high, traction at the drive sheaves 32, 34 will be affected. Further, the tension is controlled and the ropes are smoothly captured and released by the ROTDs 122 to minimize tension disturbance on the elevator car 10, thus improving ride quality.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:

a hoistway;

an elevator car disposed in and movable along the hoistway, the elevator car including a first sheave and a second sheave spaced apart from the first sheave, the first sheave and second sheave having parallel axes of rotation, the first sheave and second sheave each including:

a traction surface; and a gearless prime mover operably connected to the traction surface to drive rotation of the traction surface, the gearless prime mover including a motor, inverter and bearing disposed radially insider of the first sheave and the second sheave;

a first load bearing member disposed in the hoistway;

a second load bearing member disposed in the hoistway; and a power storage module located at the elevator car and operably connected to the gearless prime mover and configured to drive the gearless prime mover;

wherein the first load bearing member passes laterally under the first sheave, vertically upward between the first sheave and the second sheave, and laterally over the second sheave, and wherein the second load bearing member passes laterally under the second sheave, vertically between the second sheave and the first sheave, and laterally over the first sheave.

2. The elevator system of claim 1, wherein the gearless prime mover is a hub wheel motor.

3. The elevator system of claim 2, wherein the hub wheel motor is mounted on a shaft.

4. The elevator system of claim 1, wherein the gearless prime mover is operably connected to a power source located remotely from the elevator car.

5. The elevator system of claim 4, wherein the prime mover is configured to generate electrical power and return the generated electrical power to the power source.

6. The elevator system of claim 4, wherein the connection to the remotely-located power source is one of inductive or conductive.

7. The elevator system of claim 4, wherein an interface between the prime mover and the remotely-located power source includes the power storage module.

8. The elevator system of claim 1, wherein the load bearing member is one of a rope or a belt.

9. The elevator system of claim 1, further comprising:

a second elevator car disposed in the hoistway, the second elevator car including a third sheave and a fourth sheave spaced apart from the third sheave, the third sheave and fourth sheave having parallel axes of rotation, the third sheave and the fourth sheave each including:

a traction surface; and a gearless prime mover operably connected to the traction surface to drive rotation of the traction surface;

a third load bearing member disposed in the hoistway; and a fourth load bearing member disposed in the hoistway;

wherein the third load bearing member passes laterally under the third sheave, vertically upward between the third sheave and the fourth sheave, and laterally over the fourth sheave, and wherein the fourth load bearing member passes laterally under the fourth sheave, vertically between the fourth sheave and the third sheave, and laterally over the third sheave.

10. The elevator system of claim 9, wherein the third sheave is axially offset from the first sheave and the fourth sheave is axially offset from the seconds sheave.

11. The elevator system of claim 9, further comprising a third or more elevator car disposed in the hoistway.

12. The elevator system of claim 1, further comprising one or more tension offset devices positioned in the hoistway to selectively restrain and release the first load bearing member and/or the second load bearing member to control the tension of the first load bearing member and/or the second load bearing member.

13. The elevator system on claim 12, wherein the tension offset device is configured to:

release an associated load bearing member before the elevator car passes the tension offset device; and restrain the associated load bearing member after the elevator car passes the tension offset device.

14. The elevator system of claim 12, wherein the tension offset device is configured to apply an upward force to the first load bearing member and/or the second load bearing member.

* * * * *